US011851271B2

(12) United States Patent
Middelkoop

(10) Patent No.: US 11,851,271 B2
(45) Date of Patent: Dec. 26, 2023

(54) DEVICE FOR ARRANGING AND HOLDING THEREIN CONTAMINATED OBJECTS

(71) Applicant: CONFUCIUS HOLDING B.V., Epse (NL)

(72) Inventor: Maarten Middelkoop, Doetinchem (NL)

(73) Assignee: CONFUCIUS HOLDING B.V., Epse (NL)

( * ) Notice: Subject to any disclaimer, the term of this patent is extended or adjusted under 35 U.S.C. 154(b) by 191 days.

(21) Appl. No.: 17/418,354

(22) PCT Filed: Dec. 23, 2019

(86) PCT No.: PCT/NL2019/050873
§ 371 (c)(1),
(2) Date: Jun. 25, 2021

(87) PCT Pub. No.: WO2020/141972
PCT Pub. Date: Jul. 9, 2020

(65) Prior Publication Data

US 2022/0081205 A1 Mar. 17, 2022

(30) Foreign Application Priority Data

Jan. 3, 2019 (NL) ..... 2022340

(51) Int. Cl.
*B65F 1/10* (2006.01)
*B65F 1/16* (2006.01)

(52) U.S. Cl.
CPC ..... *B65F 1/10* (2013.01); *B65F 1/163* (2013.01); *B65F 1/1607* (2013.01);
(Continued)

(58) Field of Classification Search
CPC ..... B65F 1/10; B65F 1/1607; B65F 1/163; B65F 1/1646; B65F 2001/1676; B65F 2240/132
(Continued)

(56) References Cited

U.S. PATENT DOCUMENTS 5,213,228 A * 5/1993 Chang ..... B65F 1/06 220/495.08
2010/0133271 A1* 6/2010 Garland ..... B65F 1/10 220/254.1

FOREIGN PATENT DOCUMENTS

WO 9606788 A1 3/1996
WO 2006126879 A2 11/2006

OTHER PUBLICATIONS

International Search Report and Written Opinion for the International Patent Application No. PCT/NL2019/050873, dated Mar. 12, 2020, 12 pages.
(Continued)

*Primary Examiner* — John K Fristoe, Jr.
*Assistant Examiner* — Elizabeth J Volz
(74) *Attorney, Agent, or Firm* — KDW FIRM PLLC

(57) ABSTRACT

Device for arranging and holding therein contaminated objects, particularly contaminated objects such as contaminated nappies. The device includes a container and a lid. The lid includes a hollow tube, open on at least an outer end, in which a body is arranged in reciprocally movable manner. The lid can pivot relative to the container between a first position, in which an object can be arranged in the tube from the outside, and a second position, in which the body can move downward in the tube under the influence of the force of gravity in order to push the object into the container. The device further includes a pedal and a releasing device, where the releasing device pivots the lid from the second position
(Continued)

to the first position during a displacement of the pedal due to a pedal force exerted on the pedal.

16 Claims, 11 Drawing Sheets

(52) U.S. Cl.
CPC .... *B65F 1/1646* (2013.01); *B65F 2001/1676* (2013.01); *B65F 2240/132* (2013.01)

(58) Field of Classification Search
USPC ..... 220/263, 495.01, 495.06, 495.05, 908, 220/908.1, 908.3
See application file for complete search history.

(56) References Cited

OTHER PUBLICATIONS

International Preliminary Report on Patentability for PCT/EP2019/050873, dated Jul. 21, 2021, eight (8) pages.

* cited by examiner

DEVICE FOR ARRANGING AND HOLDING THEREIN CONTAMINATED OBJECTS

This is a national stage application filed under 35 U.S.C. § 371 of pending international application PCT/NL2019/050873, filed Dec. 23, 2019, which claims priority to Netherlands Patent Application No. NL 2022340, filed Jan. 3, 2019, the entirety of which applications are hereby incorporated by reference herein.

The invention relates to a device for arranging and holding therein contaminated objects, particularly contaminated objects such as contaminated nappies, comprising a container and a lid, wherein the lid comprises a hollow tube, open on at least an outer end, in which a body is arranged in reciprocally movable manner, wherein the lid can pivot relative to the container between a first position, in which an object can be arranged in the tube from the outside, and a second position in which the body can move downward in the tube under the influence of the force of gravity in order to push the object into the container. It is noted that the term nappies is understood to mean not only baby nappies, but also incontinence nappies, particularly for adults.

A device according to the preamble as described above is for instance known from the European patent publication no. EP 0 776 305. In the known device the lid forms a one-way valve, wherein the tube is embodied as a cylinder and the body as a piston reciprocally slidable therein. When the lid of the known device is in the first position, objects can be placed in the cylinder and the lid can then be pivoted into the second position by the user. The piston here drops down under the influence of the force of gravity and thus pushes the objects into the container.

The above described known device is in practice usually used in healthcare services, particularly in elderly care. The workload in such care institutions is usually high, and a high degree of hygiene is important therein, particularly when handling contaminated objects. There is therefore a need to improve the efficiency and/or hygiene of the known device.

It is an object of the invention to improve the prior art device, and for this purpose a device of the type stated in the preamble according to the invention has the special feature that it comprises a pedal and a releasing device, wherein the releasing device pivots the lid from the second position to the first position during a displacement of the pedal due to a pedal force exerted on the pedal. Alternatively, the device can be configured such that the lid pivots from the first position to the second position during a displacement of the pedal.

As a result of the above stated improvement of the prior art device the user need not use his or her hands during operation thereof. This is because the user can pivot the lid from the second position to the first position with a single operation, and then place the object in the tube with one hand. In other words, the user will not touch the device with his or her hands during use, whereby the outer surfaces of the device in particular remain clean. i.e. hygienic. A subsequent user will hereby not have to come into contact either with contamination left by a previous user. An additional advantage is that the user need not perform a pivoting movement of the lid manually, but can pivot the lid to the opened position solely with foot pressure. This saves time for the user, and the efficiency of a device according to the invention is thereby increased relative to the known device.

In a preferred embodiment of a device according to the invention the releasing device comprises an opening element, wherein the opening element is connected to the pedal and the lid such that the opening element pivots the lid from the second position to the first position during the displacement of the pedal due to a pedal force exerted on the pedal. The opening element preferably comprises a cable, wherein the cable is connected to the pedal and the lid such that the cable pulls the lid from the second position to the first position during the displacement of the pedal due to a pedal force exerted on the pedal. A push rod, electronically driven mechanism or other opening element known to the skilled person can be provided as an alternative to a cable.

In a further preferred embodiment of a device according to the invention the releasing device comprises a closing element, wherein the releasing device pivots the lid from the first position to the second position under the influence of the closing element when the displacement decreases. A particular advantage of a device with such a closing element is an increased efficiency, since the pivoting of the lid from the second position to the first position, and back again from the first position to the second position, can be achieved in one operation. After placing an object in the tube, the user can therefore lift his or her foot off the pedal and continue other activities immediately, while the releasing device pivots the lid to the second position under the influence of the closing element and without intervention by the user, after which the body can move downward in the tube under the influence of the force of gravity in order to push the object into the container.

In a further preferred embodiment of a device according to the invention the closing element comprises a spring which is connected to the opening element, such as the cable, wherein the spring is tensioned by the displacement of the pedal, such that the opening element, such as the cable, pivots the lid, for example pulls it, from the first position to the second position when the displacement decreases through the tensioned spring. The spring therefore makes it possible to return the cable to its rest state, i.e. the state of the cable in which no pedal force is exerted on the pedal, so that the lid pivots from the first position to the second position. The spring is preferably a biased compression spring. As a result of the bias in such a compression spring the spring force increases only a little when it is compressed, whereby the pedal force to be exerted remains at least substantially constant when the pedal is pushed down. An additional advantage of a biased compression spring is that it is significantly more compact than a tension spring. The compression spring is preferably built into a spring sleeve, such as a tube, whereby a cable running through the spring sleeve can exert a tensile force on the spring. As an alternative to the spring, the closing element can comprise a counter-weight which is pulled upward during displacement of the pedal, and returns to its lower rest position when the displacement of the pedal decreases, in order to pivot the lid from the first position to the second position.

In a further preferred embodiment of a device according to the invention the container comprises an upper part with an opening, wherein in the second position of the lid the opening of the upper part connects to the open outer end of the tube in order to be able to push the object from the tube, through the opening of the upper part and into the container by means of the body. The upper part preferably comprises a recess for at least partially receiving the lid therein.

In a further preferred embodiment of a device according to the invention the opening of the upper part comprises along its peripheral edge a seal. In the second position the lid preferably rests on the seal in order to enable the container to be closed substantially airtightly. Possible odours and/or fumes coming from the contaminated object remain substantially locked in the container owing to the seal, whereby the immediate vicinity of the device is not inconvenienced by odours and/or moisture. This preferred embodiment therefore provides a hygienic and odorless (working) environment for the user.

In a further preferred embodiment of a device according to the invention the lid is provided with two protrusions, arranged opposite each other, which are arranged in correspondingly shaped recesses of the container. At least one of the protrusions preferably comprises a gear wheel, wherein a drive gear of the releasing device engages on the gear wheel in order to pivot the lid from the first position to the second position and vice versa. More preferably, the gear wheel and the drive gear define a line of contact with a pressure angle greater than 0°, such that the lid is lifted from the second position when the releasing device pivots the lid from the second position to the first position, in order to reduce the friction between the lid and the container. Still more preferably, the outer radius of the gear wheel is smaller along at least a part of the periphery of the gear wheel than a maximum outer radius of the gear wheel, wherein in the second position of the lid the drive gear engages on that part, in order to guarantee engagement of the gear wheel and the drive gear when the lid is lifted from the second position. Alternatively, the outer radius of the drive gear can be smaller along at least a part of the periphery of the drive gear than a maximum outer radius of the drive gear, wherein in the second position of the lid the gear wheel engages on that part, in order to guarantee engagement of the drive gear and the gear wheel when the lid is lifted from the second position. At least one of the protrusions preferably comprises on one side a radially extending protuberance and on the other side a radially inward protuberance.

In a further preferred embodiment of a device according to the invention the cable is connected along at least a part of its length to the gear wheel, wherein the spring is connected on a side of that part to the cable and the pedal is connected on the other side of that part to the cable, in order to pivot the lid from the first position to the second position and vice versa. The lid is hereby pivoted from the first position to the second position by a tensile force of the spring on the gear wheel, and the lid is pivoted from the second position to the first position by a tensile force of the pedal on the gear wheel. An increasing pedal force therefore results in the pivoting of the lid from the second position to the first position, wherein an object can be arranged in the tube from the outside, and a decreasing pedal force results in the pivoting of the lid from the first position to the second position, wherein the body can move downward in the tube under the influence of the force of gravity in order to push the object into the container.

The invention will be further elucidated hereinbelow with reference to the accompanying drawings.

Figure 1:
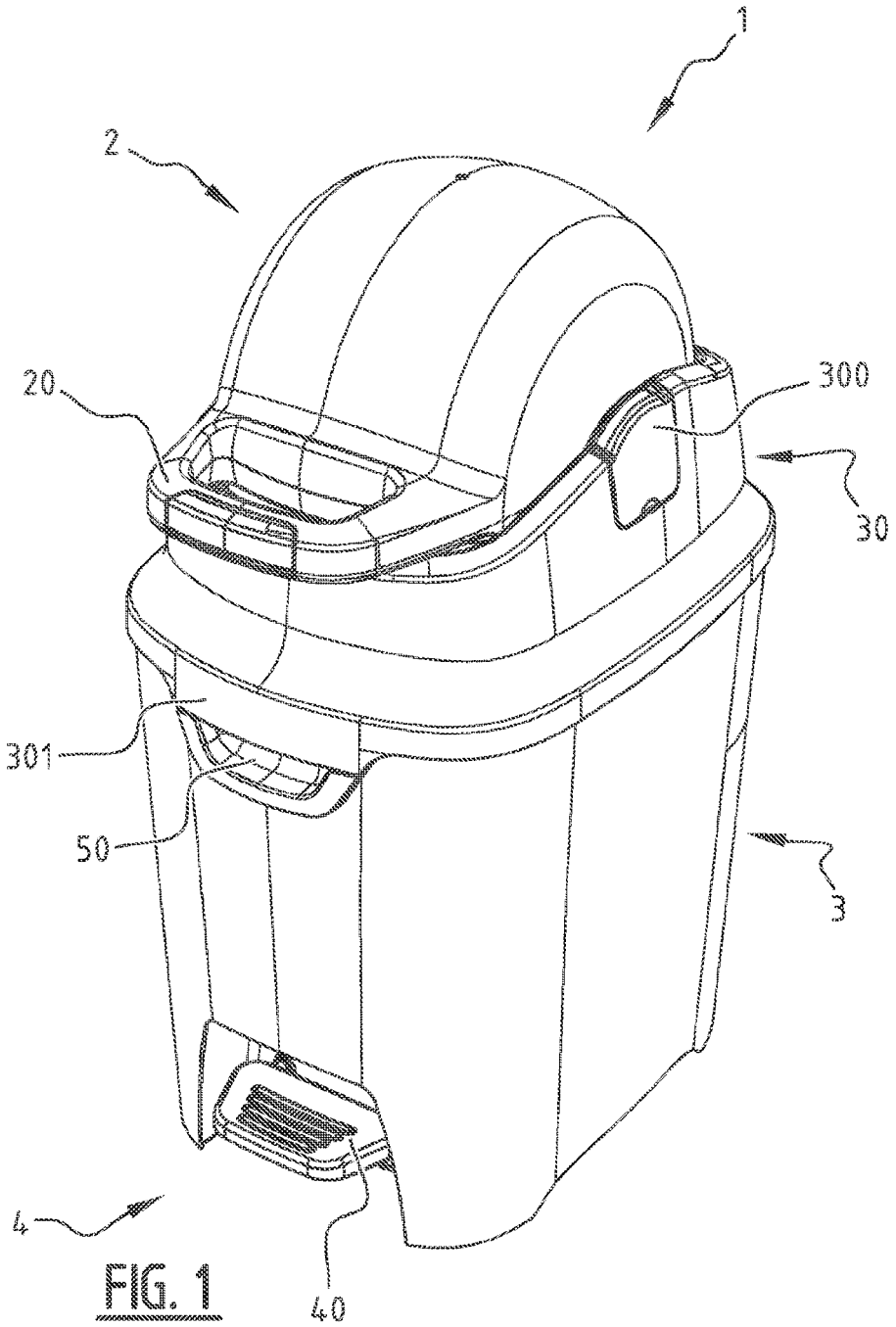
FIG. 1 shows an embodiment of a device according to the invention, wherein the lid is in the second position.

FIG. 1 shows a device 1 for arranging and holding therein contaminated objects, particularly contaminated objects such as contaminated nappies. Device 1 has a lid 2 and a container 3. FIG. 1 shows a situation in which lid 2 is in a second position. Container 3 further has an upper part 30 on which lid 2 is pivotally arranged. Lid 2 pivots by means of protrusions 23 (not shown here) arranged thereon, which are shielded by one or more protective covers 300 which can be mounted releasably on upper pan 30, for instance by means of a snap connection. Device 1 further comprises a pedal 4 which is substantially placed such that it can be operated by a user using his or her foot. For this purpose a user exerts a downward force, for instance using his or her foot, on the upper surface 40 of pedal 4, after which lid 2 pivots from the second position to a first position (see FIG. 2) when the pressure on upper surface 40 increases. In addition to pedal 4, shown device 1 provides for manual operation in the form of a handle 20, with which a user can pivot lid 2 between the first position (FIG. 2) and the second position (FIG. 1) by gripping it. Such a handle 20 is further suitable for lifting lid 2 when it has been detached from the rest of device 1. Upper part 30 also comprises an opening flange 301 which can be gripped by a user to pivot upper part 30, optionally together with lid 2 when they are attached to each other, away from the rest of container 3 in order to provide access to the interior 31 of container 3.

Figure 2:
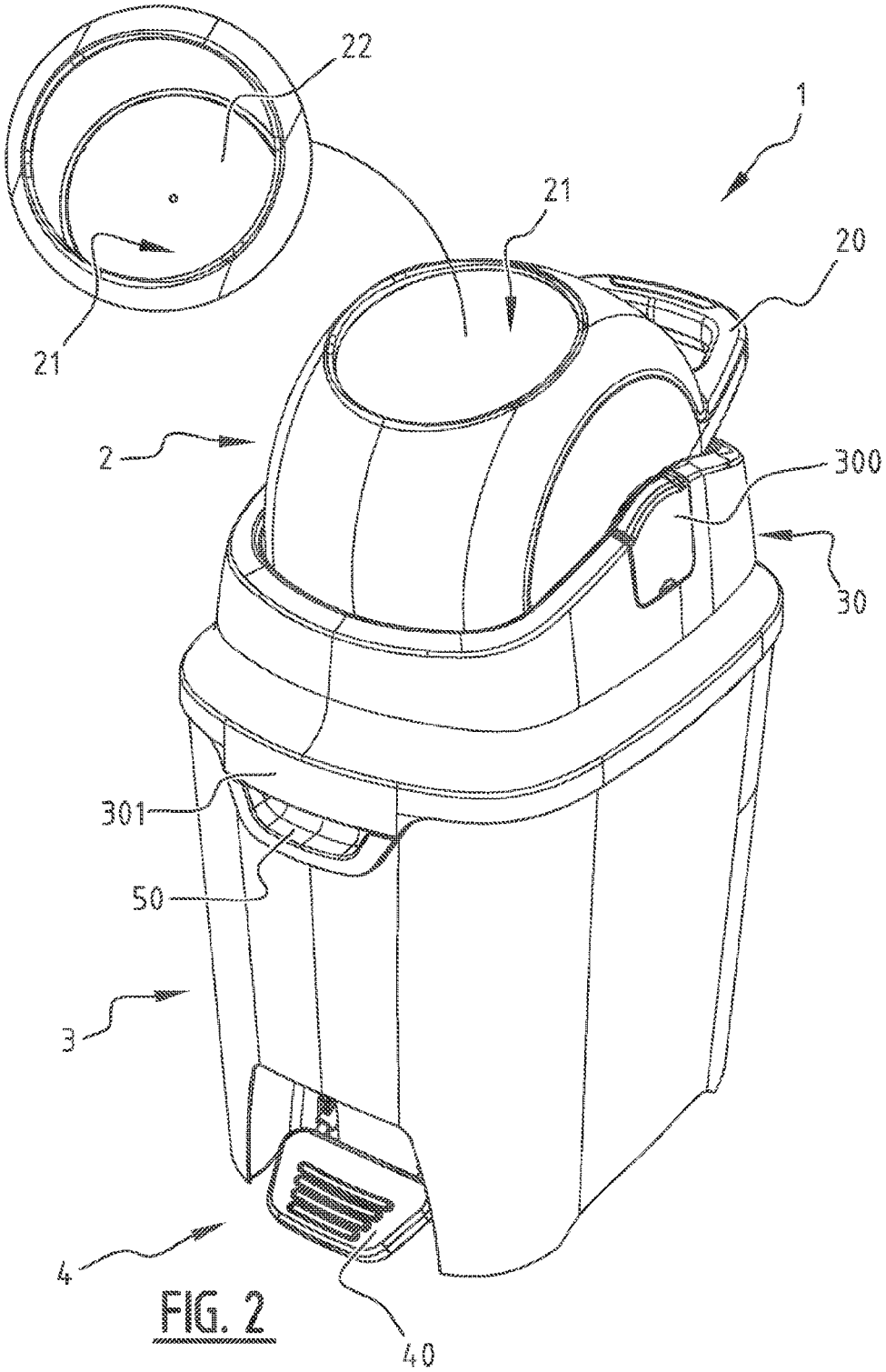
FIG. 2 shows the embodiment of the device according to FIG. 1, wherein the lid is in the first position.

FIG. 2 shows the device 1 of FIG. 1, wherein lid 2 is in the first position. Lid 2 comprises a hollow tube 21, open on at least an outer end, in which a body, in this case a piston 22 reciprocally slidable in tube 21, is arranged. This piston 22 is configured such that it can slide reciprocally between the opening of tube 21 and the bottom of tube 21. In the first position of the lid, i.e. wherein the opening of tube 21 points upward as shown here, piston 22 moves toward the bottom of tube 21, i.e. away from the opening, under the influence of the force of gravity. When lid 2 is in the second position (sec FIG. 1), piston 22 moves downward in tube 21 under the influence of the force of gravity in order to push an object which may have been placed in tube 21 into container 3. The embodiment of the device 1 as shown in FIGS. 1 and 2 is configured such that tube 21 is accessible to a user when lid 2 is substantially in the first position. As described above, a downward force must be exerted on the upper surface 40 of pedal 4 in order to pivot lid 2 from the second position (FIG. 1) to the first position (FIG. 2). FIG. 2 shows a substantially downward displacement of pedal 4, relative to the situation in FIG. 1. A pedal mechanism wherein the above stated force must be exerted in a direction other than downward can likewise be envisaged. Pedal 4 can be embodied in different ways, which are known to skilled person, such as a handle or a knob and the like.

Figure 3:
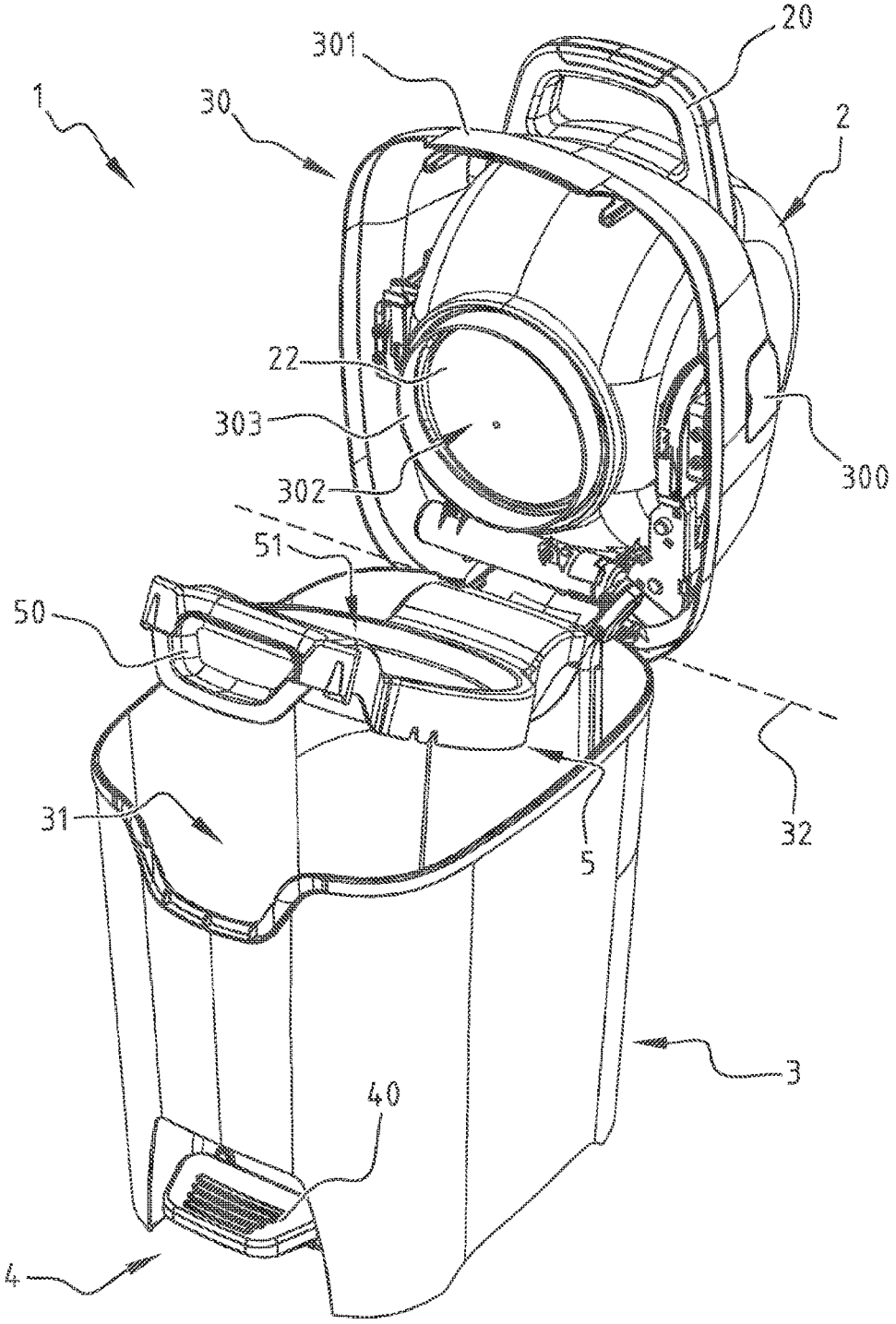
FIG. 3 shows the embodiment of a device according to FIGS. 1 and 2, wherein the lid, together with an upper part of the container, is pivoted away from the container.

FIG. 3 shows an embodiment according to FIGS. 1 and 2 wherein lid 2, together with the upper part 30 of container 3, is pivoted away from container 3. In the situation as shown here the interior 31 of container 3 is accessible to a user of device 1. Device 1 likewise comprises a bag holder 5 to which a bag (not shown), such as a refuse bag, can be attached so that a contaminated object which is pushed into container 3 by piston 22 comes to lie in the bag, so that the interior 31 of container 3 is not soiled. Bag holder 5 is arranged pivotally on container 3 so that it can be pivoted away from container 3 in order to make the interior 31 of container 3 more readily accessible. Bag holder 5 can likewise be pivoted away from container 3 together with upper part 30, and together with lid 2 when this lid is mounted on upper part 30. In this case it is made possible to close the bag in odorless manner before removing it from container 3, since the opening of the bag is still being closed by the mutually connecting bag holder 5, upper part 30 and/or lid 2. For the purpose of pivoting the bag holder 5 provides an engaging recess 50 which can be gripped by a user in order to pivot bag holder 5, upper part 30 and optionally lid 2 simultaneously away from container 3. Upper part 30 also has an opening 302 which in the second position of lid 2 substantially connects to the open outer end of tube 21 in order to be able to push an object from tube 21, through the opening 302 of upper part 30 and into container 3 by means of piston 22. Upper part 30 further comprises a flange 303 which extends substantially perpendicularly from the opening 302 of the lid. When upper part 30 and bag holder 5 connect to each other, flange 303 connects substantially closely to the edges of bag opening 51 of hag holder 5 in order to clamp the bag firmly therebetween.

Figure 4:
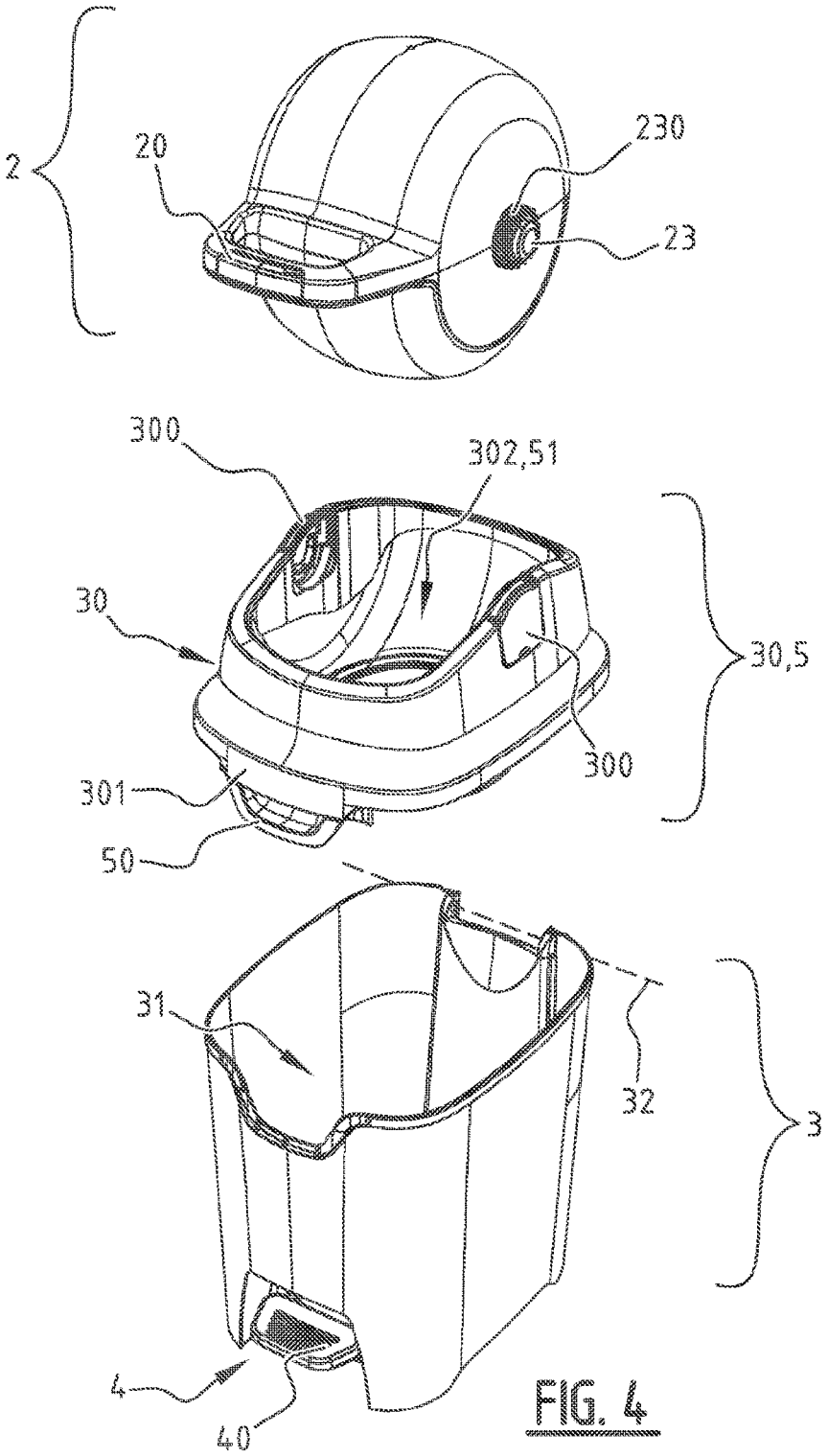
FIG. 4 shows an exploded view of an embodiment of the device.

FIG. 4 is an exploded view of device 1, divided into three parts. i.e. lid 2, upper part 30 with bag holder 5, and container 3. Lid 2 can be detached from upper part 30 when protective covers 300 have been detached from upper part 30. This is because protective covers 300 are designed such that, for instance when fastened to upper part 30 by means of a snap connection, they prevent lid 2 from being removed, since protective covers 300 enclose the protrusions 23 of lid 2. Upper part 30 further provides form closures in which protrusions 23 are received when lid 2 is mounted, in order to prevent lid 2 from being mounted in the wrong orientation. At least one of the protrusions 23 of lid 2 has teeth extending at least substantially perpendicularly of the main rotation axis of lid 2 in order to form a gear wheel 230. This gear wheel 230 can be driven by a drive gear 60 (not shown here) in order to pivot the lid between its first position and second position by means of a releasing device 6 (not shown here). In mounted state upper part 30 and bag holder 5 are connected pivotally to container 3 at its pivot axis 32. Upper part 30 and bag holder 5 can therefore be tilted both collectively and individually about this pivot axis 32.

Figure 5:
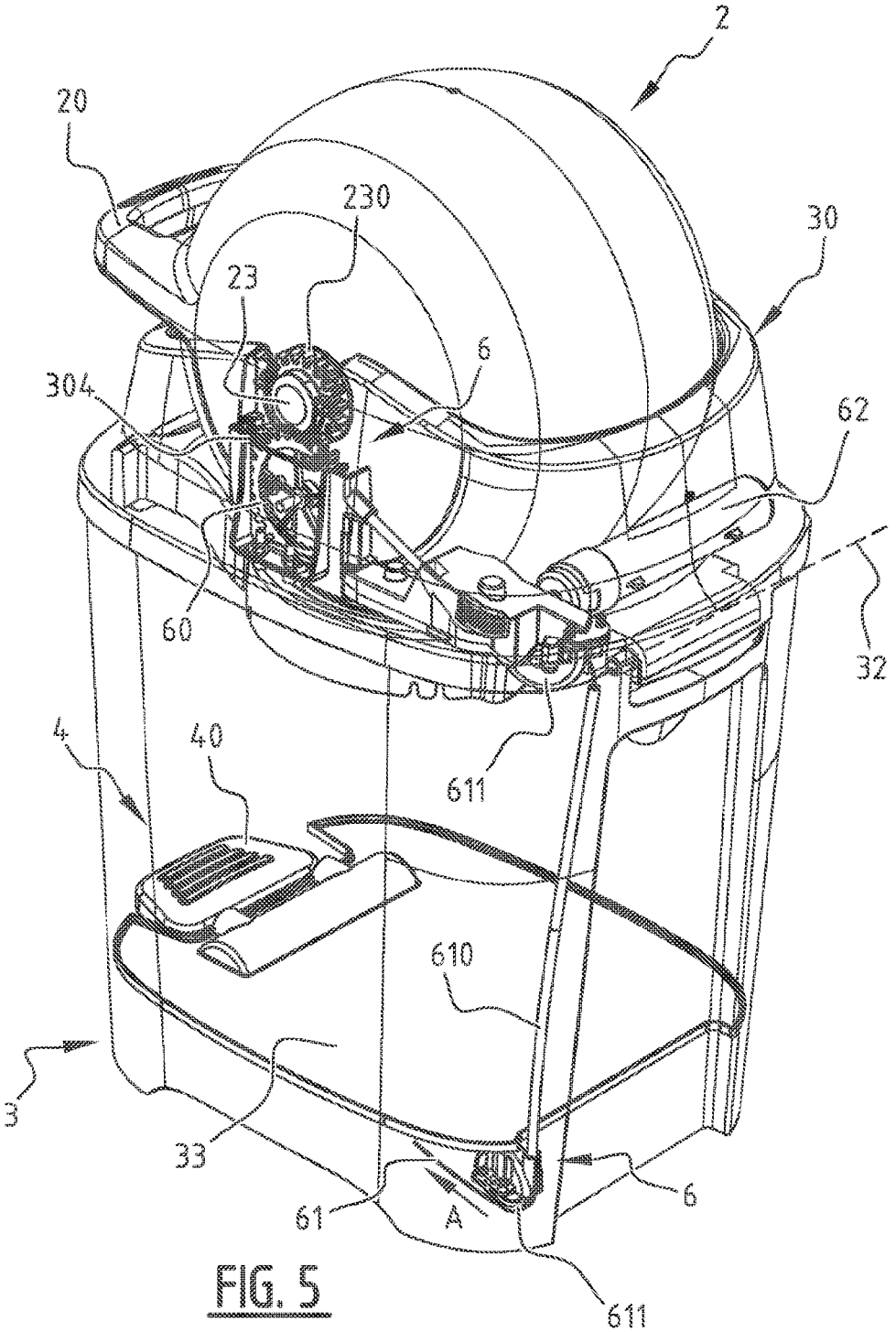
FIG. 5 shows a cut-away view of an embodiment of the device.

FIG. 5 shows a cut-away view of device 1. Pedal 4 has a converting element 41 (see for example FIGS. 6 and 8) which is shielded in this figure by a bottom plate 33 of container 3. When pedal 4 is pressed downward, a cable 61 of releasing device 6 is tightened substantially in the direction of pedal 4, i.e. in the direction of arrow A. Cable 61 is shielded in the interior 31 of container 3 by a cable sleeve 610 running substantially from bottom plate 33 to pivot axis 32. In order to reduce resistance of cable 61 during operation, particularly when it turns a corner, pulleys 611 are used. Cable 61 runs substantially from converter element 41 through the pivot axis 32 of container 3, after which cable 61 is guided toward drive gear 60. Cable 61 is connected along at least a part of its length to drive gear 60, such that drive gear 60 rotates when cable 61 is tightened. From drive gear 60, cable 61 is guided toward a spring sleeve 62 which forms part of releasing device 6. Arranged in spring sleeve 62 is a closing element, in the present embodiment a compression spring 620 (not shown), which is connected to an outer end of cable 61. When cable 61 is tightened by pedal 4, via converting element 41, spring 620 is tensioned. This means that the length of spring 620 is reduced. When the displacement of pedal 4 decreases as a result of a reduction of the pressure on the upper surface 40 of pedal 4, spring 620 is extended under the influence of the tension built up therein. Due to the extension of spring 620 cable 61 is pulled back to its rest state, i.e. the state of cable 61 in which no pressure. i.e. pedal force, is exerted on pedal 4. By tightening cable 61 and retracting it again drive gear 60 rotates respectively to the left and the right, or to the right and the left, depending on the embodiment. Lid 2 can hereby pivot from the second position to the first position by means of a pedal force on pedal 4, and lid 2 can pivot by means of the tension built up in spring 620 from the first position to the second position in the case of a reduced pedal force on pedal 4, i.e. a decreased pedal displacement.

Figure 6:
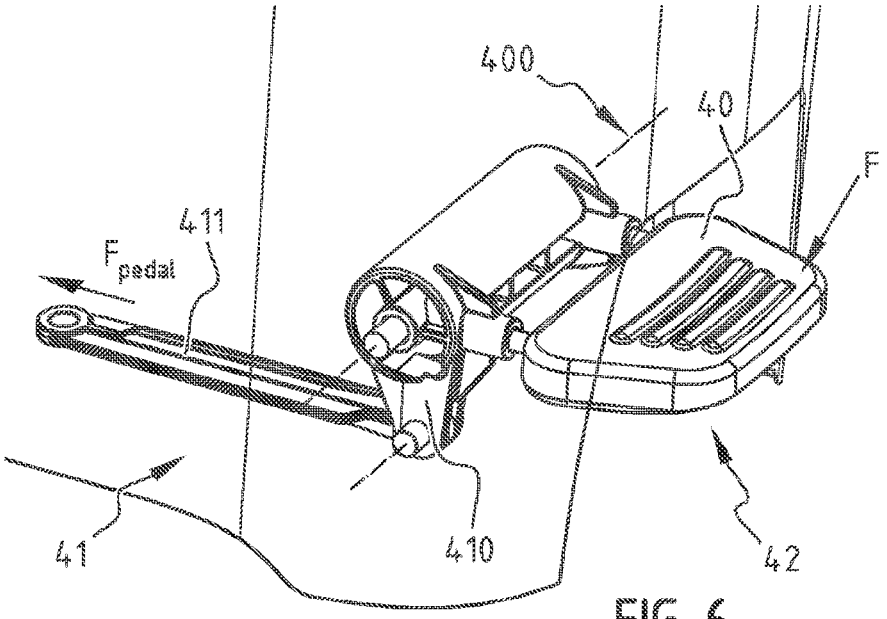
FIG. 6 shows the pedal mechanism of an embodiment of the device.

FIG. 6 shows the pedal mechanism of device 1. The above described pedal force is designated in the figure as F. When pressed in, pedal 4 rotates as a result of the pedal force F about its pedal rotation axis 400, whereby a first transmission part 410, which is connected pivotally to a second transmission part 411, likewise rotates about pedal rotation axis 400. The rotation of first transmission part 410 thereby results in a translation of the second transmission part 411, substantially parallel to the bottom of container 3. In other words, an at least substantially vertical pedal force F results in an at least substantially horizontal force $F_{pedal}$.

Figure 7:
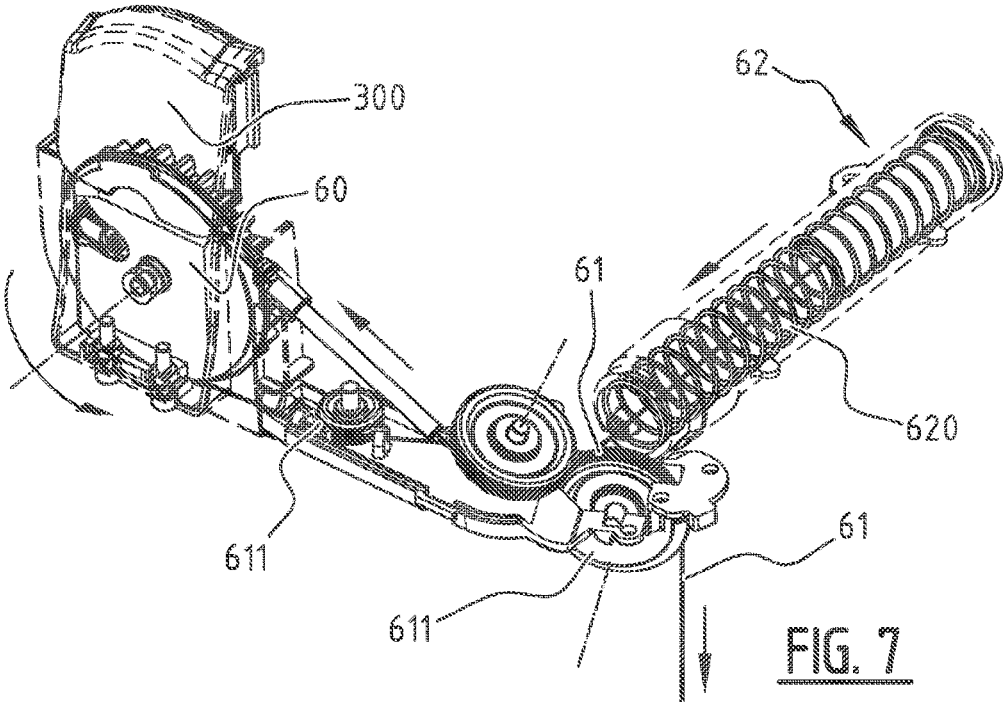
FIGS. 7 and 8 show an embodiment of a releasing device according to the invention.
Figure 8:
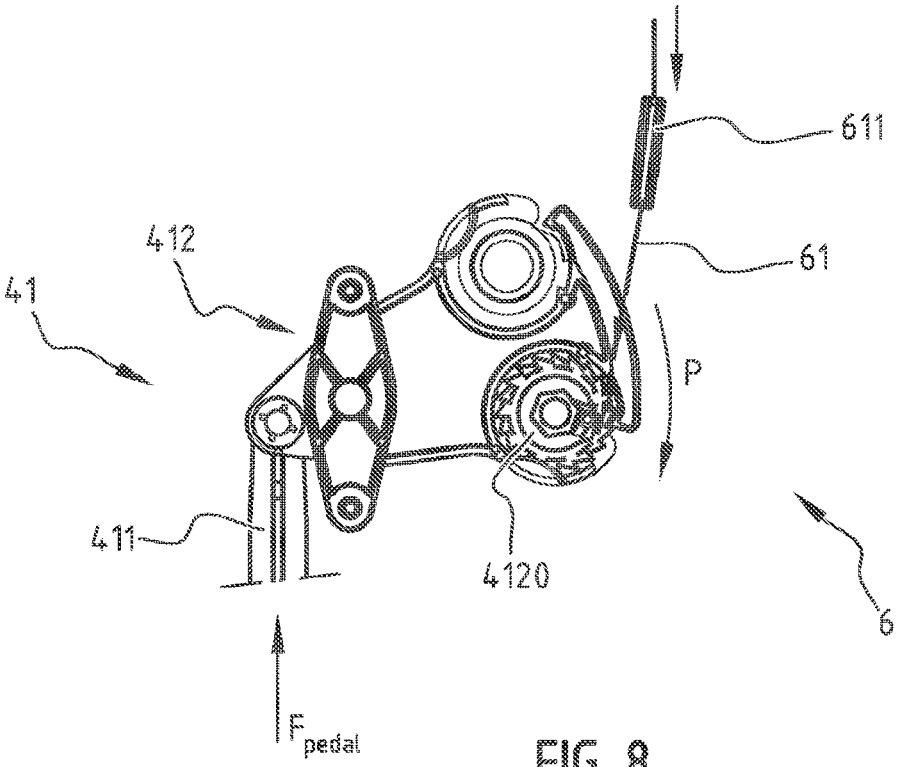

FIGS. 7 and 8 show the releasing device 6 of device 1. The horizontal force $F_{pedal}$ shown in FIG. 6 is exerted by the second transmission part 411 on a third transmission part 412, which converts the horizontal force $F_{pedal}$ into a movement P substantially in opposite direction, whereby a tensile force is exerted on cable 61. In other words, the third transmission part 412 converts the horizontal force $F_{pedal}$ into a tensile force on cable 61. Third transmission part 412 provides for a lever action, whereby a relatively small displacement of second transmission part 411 results in a relatively large displacement at the connection point of cable 61, therefore resulting in a relatively large cable displacement. The arrows shown in FIGS. 7 and 8 indicate the directions of movement of the components of releasing device 6 in the case that a pedal force F is exerted on pedal 4, i.e. in the case that lid 2 is pivoted from the second position to the first position. Cable 61, which, guided by a plurality of pulleys 611, runs from third transmission part 412 to gear wheel 60 and then to spring 620, is tightened here. Gear wheel 230 of lid 2 is therefore driven by drive gear 60. As described above, spring 620 is tensioned by the tensile force on cable 61, such that it pulls back cable 61 when the pedal displacement is reduced. The third transmission part 412 further comprises a tensioning element 4120 for tensioning cable 61 in a manner known to the skilled person.

Figure 9:
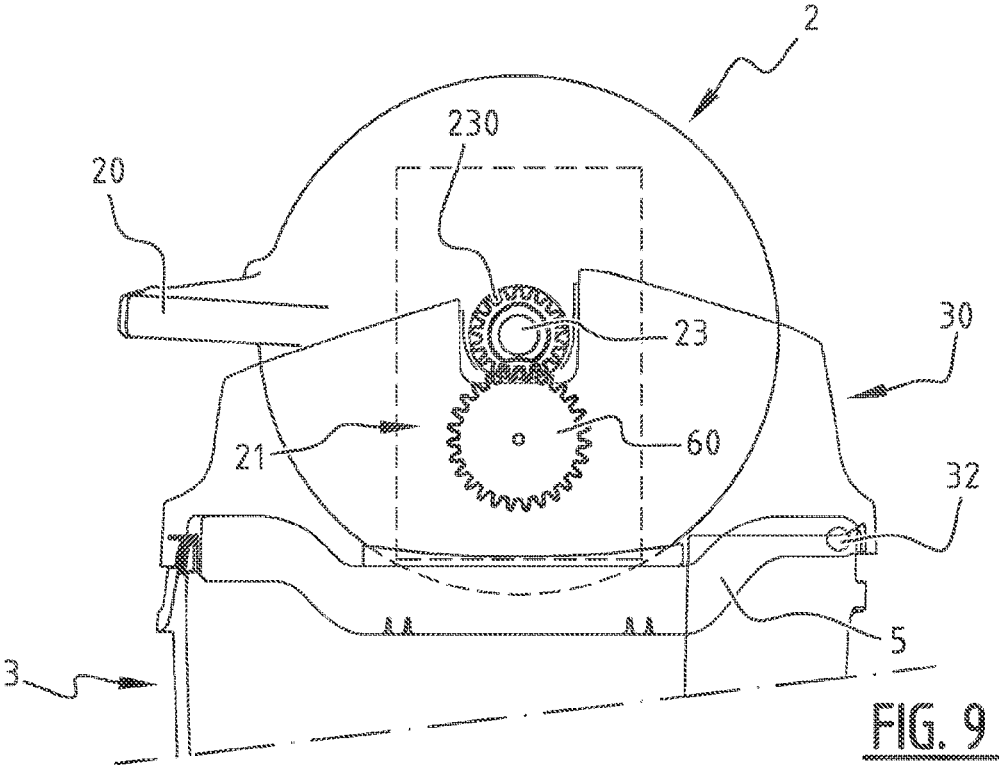
FIG. 9 shows the relative positions of a gear wheel, a drive gear and a lid according to the invention when the lid is in the second position.

FIG. 9 shows the relative positions of gear wheel 230, drive gear 60 and lid 2 when lid 2 is in the second position. In the second position the open outer end of tube 21 is pointed downward and opening 302 of upper part 30 connects thereto, so that an object placed in tube 21 can be pushed into container 3 by means of piston 22. Protrusions 23 further comprise on one side a radially extending protuberance 231 and on the other side a radially inward recess 232. In a rest position the recess 232 is filled by a correspondingly shaped edge 304 of part 30. In a rest position protuberance 231 is adjacent to a flange (not shown) of a protective cover 300. When protrusions 23 are rotated, protuberances 231 rotate away from said flanges and recesses 232 rotate away from said edge 304. This makes it possible to displace protrusions 23 substantially an upward direction. This is because the rotating away of recess 232 causes said edge 304 to push protrusion 23 substantially in upward direction. The flange of protective cover 300, co-acting with protuberance 231, further ensures that engagement of drive gear 60 and gear wheel 230 is guaranteed in an initial phase of the pivoting of lid 2.

Figure 10:
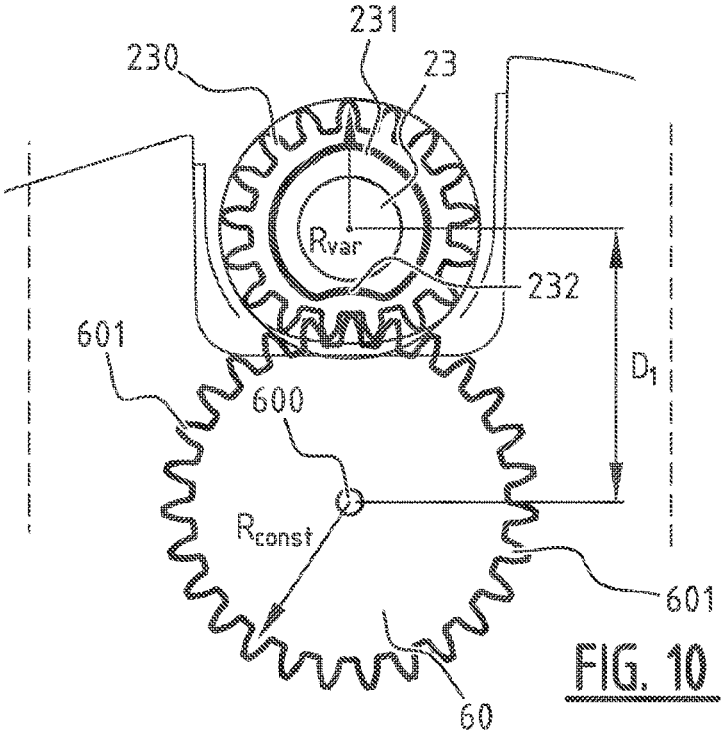
FIG. 10 shows a configuration of a gear wheel and a drive gear according to FIG. 9.

FIG. 10 shows the configuration of gear wheel 230 and drive gear 60 according to FIG. 9. Drive gear 60 has a substantially constant radius $R_{const}$ and is configured to be able to rotate about its rotation axis 600, both to the left and to the right. Drive gear 60 is driven by cable 61, which is connected thereto. Teeth 601 of drive gear 60 engage on the teeth of gear wheel 230 of the relevant protrusion 23 of lid 2. Drive gear 60 is therefore able to drive gear wheel 230 in order to be able to pivot lid 2 from the second position to the first position and vice versa. Gear wheel 230 of lid 2 has a variable radius $R_{var}$, with a maximum radius and a minimum radius. In FIG. 10. i.e. when the lid is in the second position, the part of gear wheel 230 comprising the maximum radius is directed upward and the part of gear wheel 230 comprising the minimum radius downward. In the shown situation the distance between the central point of protrusion 23 and the rotation axis 600 of drive gear 60 is defined as $D_1$.

Figure 11:
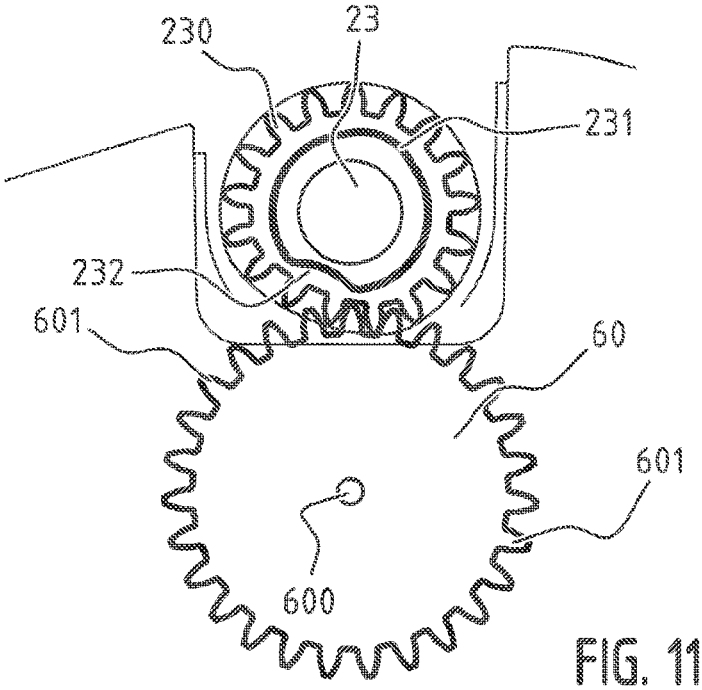
FIGS. 11 and 12 show two different relative positions of a gear wheel and drive gear according to the invention.
Figure 12:
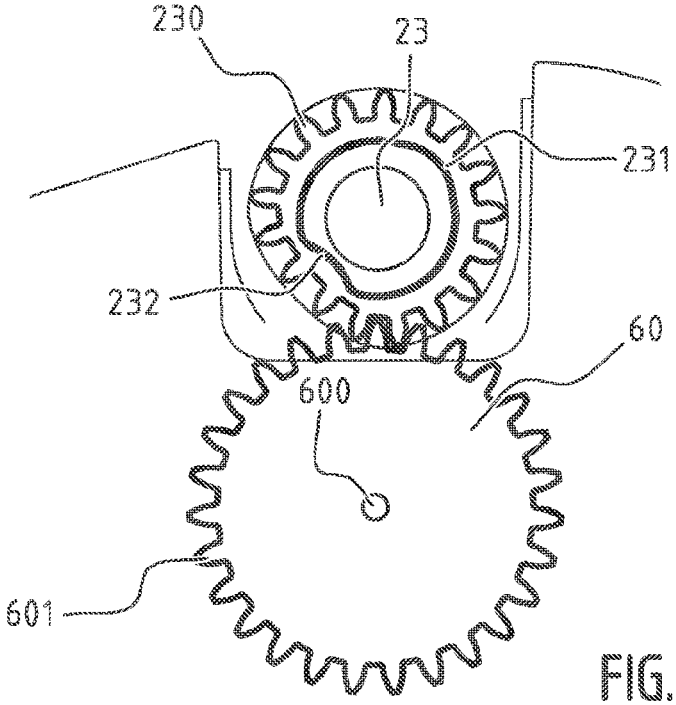

FIGS. 11 and 12 show two different relative positions of gear wheel 230 and drive wheel 60. The teeth of gear wheel 230 and drive gear 60 are configured such that they define a line of contact with a pressure angle greater than 0°, preferably between 10° and 30°, more preferably between 15° and 25°, and most preferably at least substantially 20°. As a result of this pressure angle a substantially upward force is exerted on gear wheel 230 when it is driven by drive gear 60. Lid 2 is hereby lifted when driven by drive gear 60 in order to reduce the friction between lid 2 and container 3, in the present embodiment the upper part 30, during the pivoting of lid 2. Since lid 2 is lifted during the pivoting it is particularly advantageous for the radius $R_{var}$ of gear wheel 230 to be increased gradually in order to guarantee the engagement of the teeth of gear wheel 230 and drive gear 60. FIG. 11 shows the situation wherein lid 2 is almost lifted, and FIG. 12 shows the situation wherein lid 2 has already been lifted to some extent. It will be obvious that the engagement of the teeth of the shown gear wheels 230, 60 remains guaranteed as a result of the gradually increased radius $R_{var}$ of gear wheel 230.

Figure 13:
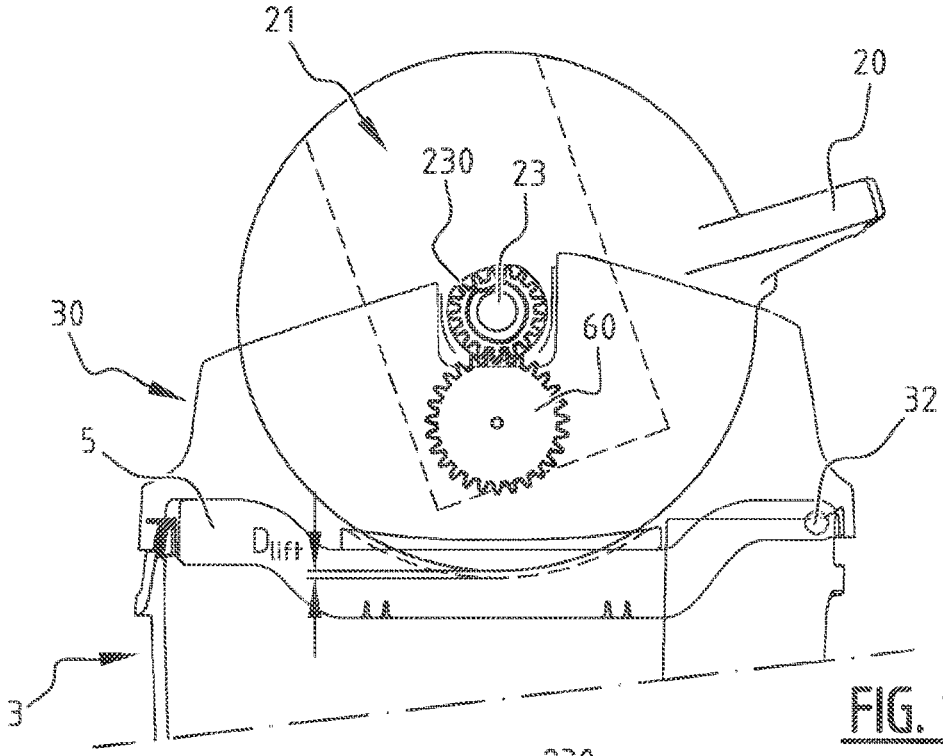
FIG. 13 shows the relative positions of a gear wheel, a drive gear and a lid according to the invention when the lid is in the first position.

FIG. 13 shows the relative positions of gear wheel 230, drive gear 60 and lid 2 when lid 2 is in the first position. In the first position the open outer end of tube 21 is directed substantially upward so that an object can be placed in tube 21. In this situation piston 22 moves downward under the influence of the force of gravity so that it comes to rest on the bottom of tube 21. It can further be clearly seen that lid 2 is lifted from the upper part 30 of container 3 to some extent. Lid 2 is hereby distanced from upper part 30, this distance being defined as $D_{lift}$.

Figure 14:
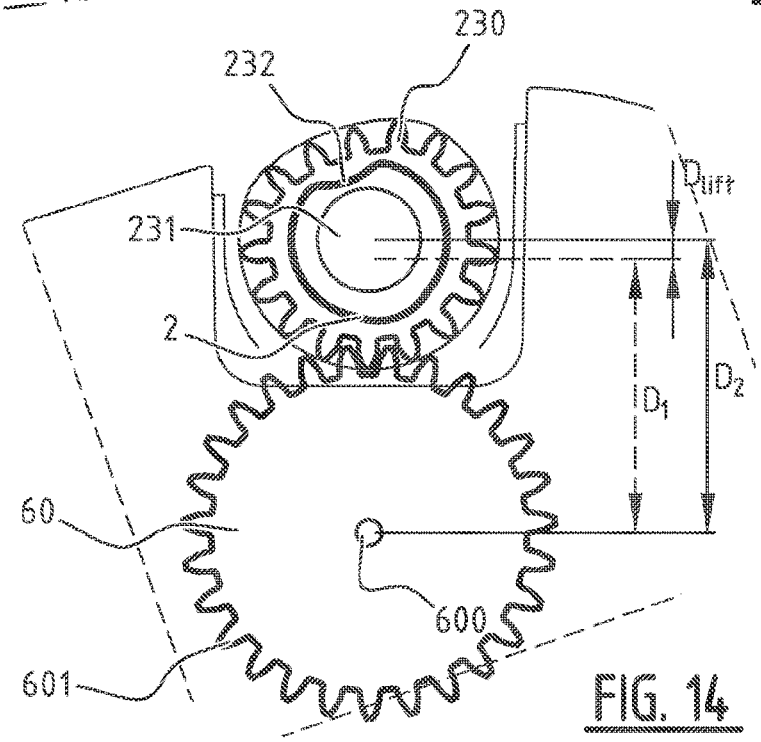
FIG. 14 shows a configuration of a gear wheel and a drive gear according to FIG. 13.

FIG. 14 shows the configuration of gear wheel 230 and drive gear 60 according to FIG. 13. As described above, the distance between the central point of protrusion 23 and the rotation axis 600 of the drive gear, when lid 2 is in the second position, is defined as $D_1$. In the first position of lid 2, lid 2 is lifted, as described above, a distance $D_{lift}$ from the upper part 30 of container 3. The distance $D_{lift}$ is caused mainly by the difference in distance between the rotation axis 600 of drive gear 60 and the central point of protrusion 23. In the first position of lid 2 the distance between rotation axis 600 of drive gear 60 and the central point of protrusion 23 is defined as $D_2$. The difference between distance $D_2$ and distance $D_1$ is substantially equal to the distance $D_{lift}$, as shown in FIG. 14. The opening 302 of upper part 30 preferably has along its peripheral edge a seal, wherein in the second position lid 2 rests on the seal in order to close container 3 substantially airtightly. This seal is for instance a rubber O-ring. Such a seal causes an increased friction between lid 2 and upper part 30, since the material of the seal, such as rubber, comprises a higher friction coefficient than the material of lid 2 and container 3, i.e. the upper part 30, which are preferably manufactured from a hard plastic. Bringing about a distance $D_{lift}$ between lid 2 and upper part 30 is therefore particularly important when such a seal is used.

Figure 15:
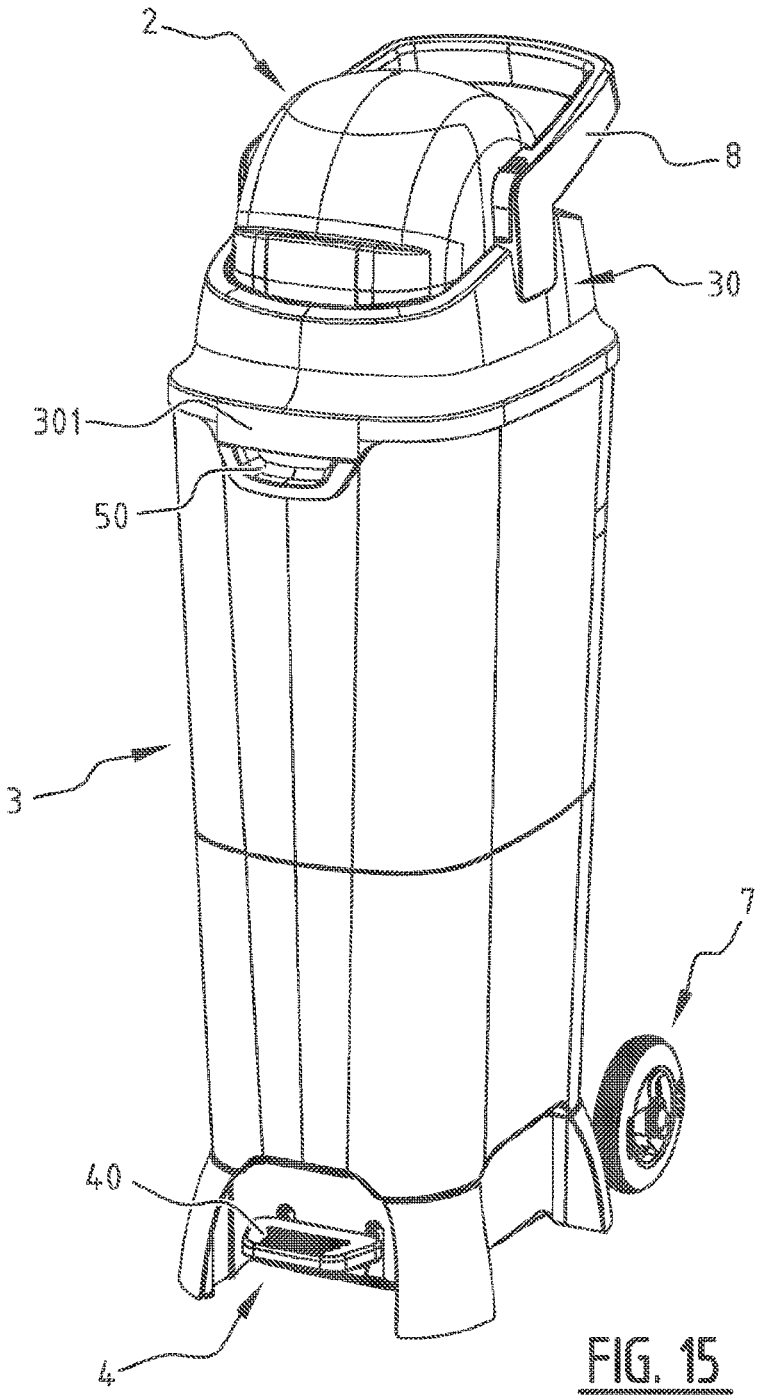
FIG. 15 shows an embodiment of the device which is equipped with wheels and a handle for displacement of the device.

FIG. 15 shows an embodiment of the device 1 according to the invention. In the shown embodiment device 1 is equipped with a displacing means, such as one or more wheels 7. Wheels 7 are arranged close to the bottom of container 3 on the rear side thereof, i.e. opposite pedal 4. A displacing handle 8 is likewise provided, which can be gripped by a user. Displacing handle 8 can be embodied such that it fulfils the function of the protective covers 300. A part of the displacing handle 8 can further form a shape lock, such that lid 2 can only be placed in upper part 30 in the correct orientation. The user can grip displacing handle 8 and thereby tilt device 1 rearward, such that device 1 rests wholly on its wheels 7. The user can therefore displace device 1 without significant effort, since he or she need only exert a horizontal force in order to displace device 1, while the weight of device 1 is carried substantially by the wheels 7. The embodiment as shown in FIG. 15 thereby provides a device 1 which can be displaced in simple and ergonomic manner, which enhances the physical condition of the user as compared to a device 1 which must be lifted in order to be displaced.

It is noted that the invention is not limited to the drawn embodiments, but also extends to other variants falling within the scope of the appended claims.

The invention claimed is:

1. A device for arranging and holding therein contaminated objects, the device comprising:
- a container and a lid,
- wherein the lid comprises a hollow tube, open on at least an outer end, in which a body is arranged in reciprocally movable manner,
- wherein the lid is pivotable relative to the container between a first position, in which an object can be arranged in the tube from the outside, and a second position in which the body can move downward in the tube under the influence of the force of gravity in order to push the object into the container,
- wherein the device comprises a pedal and a releasing device, and
- wherein the releasing device is configured to pivot the lid from the second position to the first position during a displacement of the pedal due to a pedal force exerted on the pedal.

2. The device according to claim 1, wherein the releasing device comprises an opening element, wherein the opening element is connected to the pedal and the lid such that the opening element pivots the lid from the second position to the first position during the displacement of the pedal due to a pedal force exerted on the pedal.

3. The device according to claim 2, wherein the opening element comprises a cable, and wherein the cable is connected to the pedal and the lid such that the cable pulls the lid from the second position to the first position during the displacement of the pedal due to a pedal force exerted on the pedal.

4. The device according to claim 2, wherein the releasing device comprises a closing element, wherein the releasing device pivots the lid from the first position to the second position under the influence of the closing element when the displacement decreases, and wherein the closing element comprises a spring which is connected to the opening element, and wherein the spring is tensioned by the displacement of the pedal, such that the opening element pivots the lid from the first position to the second position when the displacement decreases through the tensioned spring.

5. The device according to claim 4, wherein the spring is a biased compression spring.

6. The device according to claim 4, wherein the lid is provided with two protrusions, arranged opposite each other, which are arranged in correspondingly shaped recesses of the container, wherein at least one of the protrusions comprises a gear wheel, wherein a drive gear of the releasing device engages on the gear wheel in order to pivot the lid from the first position to the second position and vice versa; and wherein the opening element comprises a cable, wherein the cable is connected along at least a part of its length to the gear wheel, and wherein the spring is connected on a side of that part to the cable and the pedal is connected on the other side of that part to the cable, in order to pivot the lid from the first position to the second position and vice versa.

7. The device according to claim 1, wherein the releasing device comprises a closing element, and wherein the releasing device pivots the lid from the first position to the second position under the influence of the closing element when the displacement decreases.

8. The device according to claim 1, wherein the container comprises an upper part with an opening, and wherein in the second position of the lid the opening of the upper part connects to the open outer end of the tube in order to be able to push the object from the tube through the opening of the upper part and into the container by means of the body.

9. The device according to claim 8, wherein the upper part comprises a recess for at least partially receiving the lid therein.

10. The device according to claim 8, wherein the opening of the upper part comprises along its peripheral edge a seal.

11. The device according to claim 10, wherein in the second position the lid rests on the seal in order to enable the container to be closed substantially airtightly.

12. The device according to claim 1, wherein the lid is provided with two protrusions, arranged opposite each other, which are arranged in correspondingly shaped recesses of the container.

13. The device according to claim 12, wherein at least one of the protrusions comprises a gear wheel, and wherein a drive gear of the releasing device engages on the gear wheel in order to pivot the lid from the first position to the second position and vice versa.

14. The device according to claim 13, wherein the gear wheel and the drive gear define a line of contact with a pressure angle greater than 0°, such that the lid is lifted from the second position when the releasing device pivots the lid from the second position to the first position, in order to reduce the friction between the lid and the container.

15. The device according to claim 14, wherein the outer radius of the gear wheel is smaller along at least a part of the periphery of the gear wheel than a maximum outer radius of the gear wheel, and wherein in the second position of the lid the drive gear engages on that part in order to guarantee engagement of the gear wheel and the drive gear when the lid is lifted from the second position.

16. The device according to claim 1, wherein the contaminated objects comprise contaminated nappies.

* * * * *